United States Patent [19]

Carnaghi

[11] Patent Number: 4,466,137

[45] Date of Patent: Aug. 21, 1984

[54] GARMENT WHICH CAN ACCOMMODATE A LARGE NUMBER OF WAIST SIZES AND WHICH IS HELD BY AN AUTOMATICALLY-ADJUSTABLE-LENGTH DRAWSTRING

[75] Inventor: Arturo S. Carnaghi, St. Louis, Mo.

[73] Assignee: Angelica Corporation, St. Louis, Mo.

[21] Appl. No.: 401,871

[22] Filed: Jul. 26, 1982

[51] Int. Cl.[3] ..... A41D 1/06

[52] U.S. Cl. ..... 2/237; 2/221

[58] Field of Search ..... 2/237, 76, 221, 236

[56] References Cited

U.S. PATENT DOCUMENTS 2,541,713 2/1951 Neilson ..... 2/237

2,854,670 10/1958 Naccash ..... 2/76

*Primary Examiner*—Doris L. Troutman

*Attorney, Agent, or Firm*—Rogers, Eilers & Howell

[57] ABSTRACT

A garment has an automatically-adjustable-length drawstring with readily-flexible ends that can be tied to enable the garment to accommodate a large number of waist sizes; and that drawstring will automatically expand as the circumference of the wearer's waist increases during breathing in or movement of the wearer's body, and that drawstring will automatically contract as the circumference of the wearer's waist subsequently decreases during breathing out or movement of the wearer's body. In doing so, that drawstring will hold the waist of that garment against drooping relative to a user's waist. A resilient, extensible section between the readily-flexible ends of the drawstring will automatically and continuously maintain an effective, but lower-than-normal, value of frictional force between the waist of the garment and a wearer's waist. The drawstring is disposed within a tunnel at the waist of the garment; and the major portion of the length of that drawstring is free to move circumferentially relative to that tunnel. As a result, the waist of the garment can be free of undue "bunching" and "crinkling", even where it is worn by a person whose waist size is at the lower end of the range of waist sizes to be accommodated by that garment; and the only limit to the extent to which that resilient, extensible section can be extended is the comfort level desired by the wearer for his or her waist.

9 Claims, 6 Drawing Figures

FIG. 1.
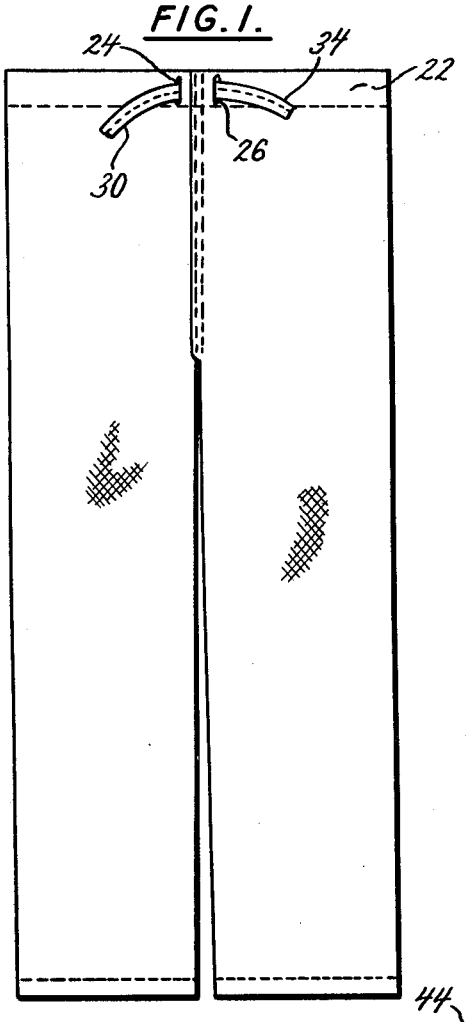
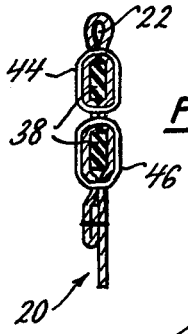
FIG. 3.
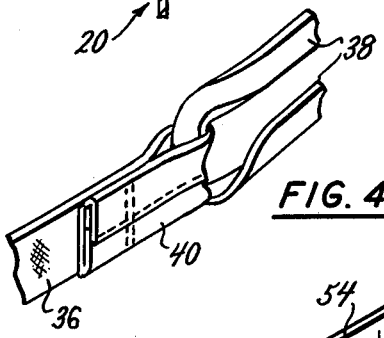
FIG. 4.
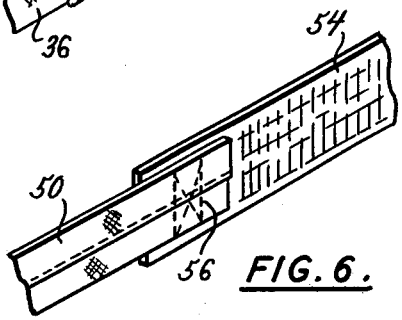
FIG. 6.
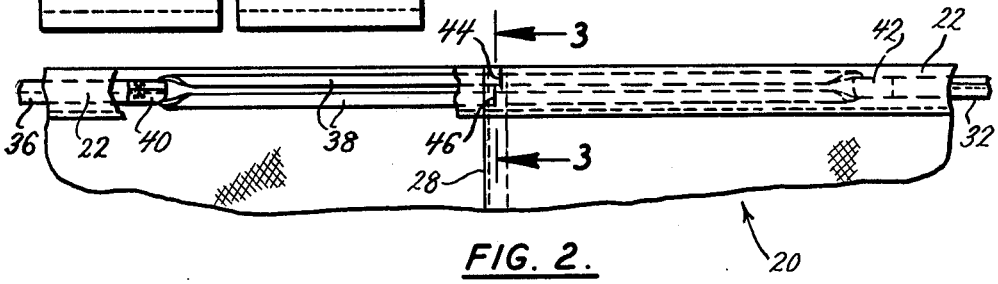
FIG. 2.
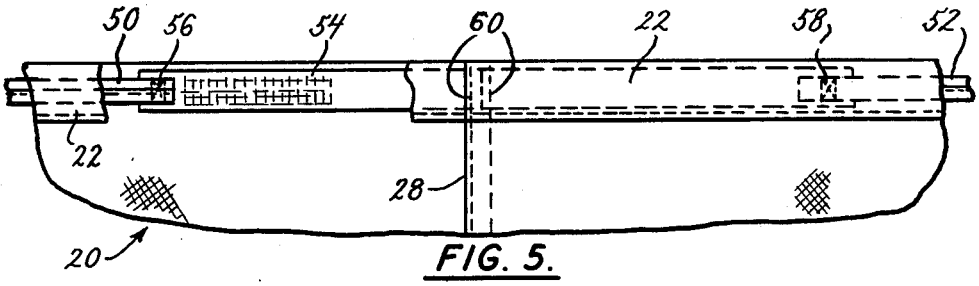
FIG. 5.

GARMENT WHICH CAN ACCOMMODATE A LARGE NUMBER OF WAIST SIZES AND WHICH IS HELD BY AN AUTOMATICALLY-ADJUSTABLE-LENGTH DRAWSTRING

BACKGROUND OF THE INVENTION

1. Field of the Invention

Garments, such as pants, are provided to encase the lower portions of the bodies of surgeons and of other persons working in operating rooms. To enable the surgeons and other persons to concentrate their attention on the surgical and other operations being performed in the operating room, the clothing worn by those surgeons and other persons should require minimal attention from those surgeons and other persons.

2. Description of the Prior Art

To enable the garments, such as pants, which encase the lower portions of the bodies of surgeons and of other persons working in operating rooms, to accommodate differing waist sizes, many of those garments are provided with drawstrings. The ends of those drawstrings are tied to provide desired frictional forces between the waists of the garments and the waists of the wearers. However, if those ends are tied as the wearer breathes in, the waist of the garment may droop as the wearer breathes out. If those ends are tied as the wearer breathes out, the frictional force may be uncomfortable when the wearer breathes in. Also, if those ends are tied as the wearer breathes out, the tied ends may slip relative to each other as the wearer breathes in. Any drooping of the waist of the garment, any slipping of the tied ends relative to each other, or any uncomfortable frictional force which tended to distract, or to disturb the concentration of, the surgeons or other persons working in an operating room would be very objectionable.

SUMMARY OF THE INVENTION

The present invention provides a body-encasing garment which has an automatically-adjustable-length drawstring with readily-flexible ends that can be tied to enable that garment to accommodate a large number of waist sizes; and that drawstring will hold the waist of that garment against drooping relative to a user's waist. That drawstring automatically expands as the circumference of the wearer's waist increases during breathing in or movement of the wearer's body, and thereby avoids all relative slipping of the readily-flexible ends which could increase the effective length of that drawstring—with consequent drooping of the waist of the garment relative to the wearer's waist as the circumference of the wearer's waist subsequently decreased. Also, that drawstring automatically contracts as the circumference of the wearer's waist subsequently decreases during breathing out or movement of the wearer's body, and thereby avoids all need of making the drawstring so tight that it would provide a desired moderate frictional force between the waist of the garment and the wearer's waist during breathing out but would provide an undesired higher frictional force between the waist of the garment and the wearer's waist during breathing in. As a result, the drawstring provided by the present invention permits a lower-than-normal frictional force to be used between the waist of the garment and the wearer's waist, and yet will automatically and continuously keep the waist of the garment from drooping relative to the wearer's waist. It is, therefore, an object of the present invention to provide a garment which has readily-flexible ends that can be tied to accommodate a large number of waist sizes and which is held against drooping relative to a user's waist by an automatically-adjustable-length drawstring that permits a lower-than-normal frictional force to be used between the waist of the garment and the wearer's waist.

The drawstring provided by the present invention has readily-flexible ends and an intermediate resilient, extensible section. Those readily-flexible ends and that resilient, extensible section enable that garment to accommodate many different waist sizes and to provide many different desired values of frictional force between the waist of the garment and the wearer's waist. That resilient, extensible section will thereafter automatically and continuously maintain the desired value of frictional force between the waist of the garment and the wearer's waist despite recurring changes in the circumference of the wearer's waist due to breathing and to body movement. It is, therefore, an object of the present invention to provide a garment with a drawstring that has readily-flexible ends and an intermediate resilient, extensible section.

The drawstring provided by the present invention is disposed within a tunnel at the waist of the body-encasing garment; and the major portion of the length of that drawstring is free to move circumferentially relative to that tunnel. As a result, the waist of the garment can be free of undue "bunching" and "crinkling", even where it is worn by a person whose waist size is at the lower end of the range of waist sizes to be accommodated by that garment. It is, therefore, an object of the present invention to provide a garment with a drawstring which has readily-flexible ends and an intermediate resilient, extensible section, which is disposed within a tunnel at the waist of the garment, and which has the major portion of the length thereof free to move circumferentially relative to that tunnel.

The tunnel of the garment provided by the present invention completely conceals and confines the resilient, extensible section plus most of the rest of the drawstring for that garment. In doing so, that tunnel protects that resilient, extensible section, obviates all need of belt loops, and obviates all need of trying to make the color of that resilient, extensible section match the color of the garment. It is, therefore, an object of the present invention to provide a garment with a tunnel which completely conceals and confines the resilient, extensible section plus most of the rest of the drawstring for that garment.

The resilient, extensible section, of the drawstring provided by the present invention, has only one area, namely, the area adjacent its midpoint, secured to the tunnel; and hence substantially the entire length of each half of that resilient, extensible section is free to extend and retract. As a result, the only limit to the extent to which the resilient, extensible section can be extended is the comfort level which the wearer of the garment desires for his or her waist. It is, therefore, an object of the present invention to provide a garment with a drawstring which has just one area of a resilient, extensible section thereof secured to a tunnel of that garment.

The flexible ends and the intermediate resilient, extensible section of the drawstring provided by the present invention coact to enable the wearer of the garment to establish a desirable frictional force between the waist of the garment and his or her waist, whether those flexible ends are tied as the wearer breathes in or breathes out. If those flexible ends are tied as the wearer breathes in, the resilient, extensible section will automatically and immediately contract as the wearer subsequently breathes out; and, in doing so, that resilient, extensible section will maintain a desirable frictional force between the waist of the garment and the wearer's waist which will prevent any drooping of the waist of the garment relative to the wearer's waist. If the flexible ends are tied as the wearer breathes out, the resilient, extensible section will automatically and immediately extend to accommodate the subsequent breathing in of the wearer; and that extension will keep the frictional force between the waist of the garment and the waist of the wearer from increasing appreciably. As a result, the garment provided by the present invention enables the wearer to establish a comfortable, lower-than-normal frictional force between the waist of the garment and the wearer's waist, and thereafter that garment will automatically and continually maintain that frictional force despite the breathing in and breathing out of the wearer. It is, therefore, an object of the present invention to provide a garment with a drawstring which has flexible ends and an intermediate resilient, extensible section and which can provide a comfortable, lower-than-normal frictional force between the waist of the garment and the wearer's waist that will prevent drooping of the garment waist relative to the wearer's waist whether those flexible ends are tied as the wearer breathes in or breathes out.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a front elevational view of a garment which is adapted to enclose the lower portion of a wearer's body, FIG. 2 is a broken elevational view, on a larger scale, of the inner surface of the upper portion of the rear of the garment of FIG. 1, FIG. 3 is a sectional view, on a still larger scale, which is taken along a plane indicated by the line 3—3 in FIG. 2, FIG. 4 is a perspective view, on the scale of FIG. 3, of a connection between the resilient, extensible section and an intermediate section of the drawstring of the garment of FIG. 1, FIG. 5 is a view which is similar to the broken elevational view of FIG. 2, but it shows a different drawstring, and FIG. 6 is a perspective view, on the scale of FIG. 3, of a connection between the resilient, extensible section and an intermediate section of the drawstring of FIG. 5.

DESCRIPTION OF THE PREFERRED EMBODIMENTS

Referring particularly to FIGS. 1–4, the numeral 20 generally denotes a pair of pants which can be worn by a surgeon or any other person working in an operating room. That pair of pants has leg-enclosing portions defining the bottom thereof and has a tunnel 22 adjacent the top thereof. As indicated particularly by FIGS. 2 and 3, that tunnel is formed by folding a portion of the top of the pants inwardly and downwardly, making a folded lower edge, and then stitching that folded lower edge to the adjacent portion of the inner surface of the pants. Openings 24 and 26 are provided in the front of the pants; and each of those openings communicates with the tunnel 22. A vertical seam 28 is provided at the rear of the pants 20, as shown particularly by FIG. 2. The leg-enclosing portions, the tunnel 22, the openings 24 and 26, and the rear seam 28 are standard and usual parts of pants and are not, per se, parts of the present invention. If desired, the tunnel 22 could be made by securing a facing to the upper portion of the pair of pants or in any other way known to those skilled in the art.

The numeral 30 denotes a readily-flexible end of the drawstring for the pants 20, and that readily-flexible end is part of an intermediate section 32 which is shown in FIG. 2. The numeral 34 denotes a second readily-flexible end for the drawstring, and that readily-flexible end is part of an intermediate section 36 which is shown by FIGS. 2 and 4. The numeral 38 denotes a resilient, extensible section of the drawstring; and, in the embodiment of FIGS. 1–4, that section is a rubberband that is ten inches long. A loop 40 is formed at the inner end of the intermediate section 36 by passing the free end of that section through the space defined by the resilient, extensible section 38, folding that free end back on an adjacent length of the intermediate section 36, and then stitching that free end to that adjacent length. A similar loop 42 is formed at the inner end of the intermediate section 32, as indicated by FIG. 2. The loops 40 and 42 make it possible to provide simple and sturdy connections between the intermediate sections 32 and 36 and the resilient, extensible section 38 without the degrading of the strength of that resilient, extensible section which would occur if a sewing needle and thread were passed through any part of that resilient, extensible section.

The numeral 44 denotes stitching which passes through the inner and outer walls of the rear portion of the tunnel 22; and that stitching causes those walls to be held in tight frictional engagement with the upper strand of the resilient, extensible section 38. The numeral 46 denotes stitching which passes through the inner and outer walls of the tunnel 22 below the stitching 44; and the stitching 46 holds those walls in tight frictional engagement with the lower strand of that resilient, extensible section. The stitching 44 and 46 coact with the front and rear walls of the tunnel 22 to effectively prevent any shifting of the midpoint of the resilient, extensible section 38 circumferentially of that tunnel while avoiding the weakening of that resilient, extensible section which would occur if a sewing needle and thread were passed through that resilient, extensible section.

The intermediate sections 32 and 36 and the readily-flexible ends 30 and 34 are dimensioned so they can freely move circumferentially relative to the tunnel 22. Similarly the resilient, extensible section 38, and the loops 40 and 42 in the inner ends of the intermediate sections 36 and 32, are dimensioned to freely move circumferentially relative to that tunnel. As a result, the wearer of the pants 20 can easily move the readily-flexible ends 34 and 30 and the intermediate sections 36 and 32 outwardly relative to the openings 24 and 26 to cause the resilient, extensible section 38 to stretch and thereby provide a desired frictional force between the inner wall of tunnel 22 and the wearer's waist. The readily-flexible ends 34 and 30 and the resilient, extensible section 38 coact to enable the wearer of the pants to establish an infinite number of specifically-different frictional forces between the inner surface of tunnel 22 and his or her waist. As a result, those readily-flexible ends and that resilient, extensible section coact to enable the pants 20 to have a standard waist size and yet be able to accommodate many different waist sizes.

In using the pants 20, the wearer will pass his or her feet and legs downwardly through the leg-enclosing portions, and then pull the tunnel 22 up to his or her waist. Thereupon, he or she will pull the readily-flexible end 30 and 34 outwardly relative to the openings 24 and 26 until a desired frictional force is established between the inner surface of tunnel 22 and his or her waist. At such time, while maintaining that desired frictional force, the wearer will tie the readily-flexible ends 30 and 34 together. The resilient, extensible section 38 will be in a stretched condition at this time; and the resulting restorative forces therein will maintain a desirable frictional force between the inner surface of the tunnel and the user's waist even if that resilient, extensible section must contract as the circumference of the wearer's waist decreases when the wearer breathes out or moves his or her body. That resilient, extensible section will additionally stretch, and will maintain a desirable frictional force between the inner surface of tunnel 22 and the wearer's waist, when the circumference of the wearer's waist increases as the wearer breathes in or moves his or her body. The resilient, extensible section 38 will automatically and immediately contract as the circumference of the wearer's waist decreases, and it will automatically and immediately expand as the circumference of the wearer's waist increases. In doing so, that resilient, extensible section will provide an automatic and immediate compensation in the length of the drawstring which will keep the tied readily-flexible ends 30 and 34 from being forced to move relative to each other—as frequently happens with the tied ends of standard and usual drawstrings when the circumference of the wearer's waist increases during breathing in or movement of the wearer's body. Also, the resilient, extensible section keeps the waist of the pants 20 from drooping, as it would do if the readily-flexible ends 30 and 34 were forced to move relative to each other. All of this means that the drawstring provided by the present invention is able to keep the pants 20 from slipping downwardly relative to the wearer's waist, and yet does not require the wearer to accept an uncomfortably-tight and restrictive frictional force between the tunnel 22 and his or her waist, and also does not require the readily-flexible ends 30 and 34 to be tied so tightly that it is difficult to loosen them.

The drawstring of the present invention is particularly useful in pants which are used by surgeons or other persons working in operating rooms; because that drawstring will avoid the distraction and loss of concentration which would inevitably occur if the waist of the pants 20 were to start drooping. Also, the drawstring of the present invention minimizes the magnitude of the frictional forces which must be established between the tunnel 22 and the wearer's waist, and hence permits optimum freedom of breathing and of movement of the wearer while minimizing perspiration of the skin at the wearer's waist. In addition, the drawstring of the present invention completely relieves the wearer of any need to re-tighten the readily-flexible ends 30 and 34 while the wearer is enclosed within a surgeon's gown, or to remove and then replace the operating room gown so those readily-flexible ends could be re-tightened. The drawstring of the present invention provides these important results by permitting the wearer to establish any desired frictional force between the inner surface of tunnel 22 and the wearer's waist, and thereafter automatically and continuously maintaining that desired frictional force.

The readily-flexible ends 30 and 34 and the resilient, extensible section 38 enable the pants 20 to accommodate a large number of waist sizes within predetermined standard waist sizes. For example, if those pants were made as "small" pants, the drawstring could accommodate many waist circumferences which ranged from less than thirty inches to more than thirty-three inches. If those pants were made as "medium" pants, the drawstring could accommodate many waist circumferences which ranged from less than thirty-four inches to more than thirty-seven inches; and if those pants were made as "large" pants, the drawstring could accommodate many waist circumferences which ranged from less than thirty-eight inches to more than forty-one inches. In each case, the drawstring would not only accommodate many waist circumferences, but would thereafter automatically and continuously maintain a desirable frictional force between the inner surface of tunnel 22 and the wearer's waist—despite recurring changes in the circumference of the wearer's waist due to breathing in and breathing out or the movement of the wearer's body.

Referring particularly to FIGS. 5 and 6, the numerals 50 and 52 denote intermediate portions of a second embodiment of drawstring that is provided by the present invention. Those intermediate portions are very similar to the intermediate portions 36 and 32, respectively, of FIGS. 2 and 4. The intermediate portions 50 and 52 will have flexible ends, not shown, which preferably will be identical to the flexible ends 34 and 30, respectively, of FIG. 1. The numeral 54 denotes a resilient, extensible section which is made from woven elastic material of standard and usual form; and the numerals 56 and 58 denote stitching which secure the inner ends of the intermediate portions 50 and 52 to the ends of the resilient, extensible section 54. The numeral 60 denotes stitching which secures the midpoint of the resilient, extensible section 54 to the midpoint of the rear of the tunnel 22.

The function and operation of the drawstring of FIGS. 5 and 6 will be essentially similar to the function and operation of the drawstring of FIGS. 1–4. However, the resilient, extensible section 54 will not be as extensible as is the resilient, extensible section 38.

Whether the drawstring of FIGS. 1–4 or the drawstring of FIGS. 5 and 6 is used, the garment will be able to accommodate a large number of waist sizes. Also, each of those drawstrings will avoid all relative slipping of the readily-flexible ends which could increase the effective length of that drawstring—with consequent drooping of the waist of the garment relative to the wearer's waist as the circumference of the wearer's waist subsequently decreased. Further, each of those drawstrings will avoid all need of making the drawstring so tight that it would provide a desired moderate frictional force between the waist of the garment and the wearer's waist during breathing out but would provide an undesired higher frictional force between the waist of the garment and the wearer's waist during breathing in. As a result, each of those drawstrings will permit a lower-than-normal frictional force to be used between the waist of the garment and the wearer's waist, and yet will automatically and continuously keep the waist of the garment from drooping relative to the wearer's waist.

Whereas the drawing and accompanying description have shown and described two preferred embodiments of the present invention, it should be apparent to those skilled in the art that various changes may be made in the form of the invention without affecting the scope thereof.

What I claim is:

1. A garment, which is adapted to enclose the lower portion of a user's body and to be held against slipping downwardly relative to said user's body by frictional engagement between the waist portion thereof and the waist of said user, and which comprises a body-enclosing section that is formed and dimensioned to enclose the lower portion of a user's body and that has a waist-engaging portion which is engageable with the waist of said user, said waist-engaging portion having a length encompassing a range of standard waist sizes of garments which enclose the lower portions of users' bodies, a drawstring which is longer than said waist-engaging portion and which has readily-flexible ends that can have differing lengths thereof tied to provide a desired effective waist size for said garment which is within said range of standard waist sizes, said drawstring having a resilient extensible section that is spaced inwardly from each of said readily-flexible ends of said drawstring, and means to hold said drawstring immediately adjacent to, and in register with, said waist-engaging portion while leaving the major portion of the length of said extensible resilient section free to move relative to said waist-engaging portion and hence free to move relative to said waist of said user, said resilient extensible section being extensible in length as said readily-flexible ends of said drawstring are moved relative to each other and then tied to cause said drawstring to urge said waist-engaging portion against said waist of said user with sufficient force to provide a frictional engagement, between said waist-engaging portion and said waist of said user, which will keep said waist-engaging portion from siipping downwardly relative to said waist of said user, said resilient extensible section being adapted to automatically extend its length even further in response to instantaneous increases in the circumference of said user's waist as said user breathes inwardly or as said user moves his body, said resilient extensible section promptly and automatically reducing its length in response to subsequent decreases in the circumference of said user's waist as said user breathes outwardly or as said user moves his body, said waist-engaging portion experiencing finite and perceptible "bunching" or "crinkling" whenever said readily-flexible ends of said drawstring are moved relative to each other and then tied to cause said drawstring to urge said waist-engaging portion against the waist of a user who has a waist size close to the lower end of said range of standard waist sizes, the freedom of the major portion of the length of said resilient, extensible section to move relative to said waist-engaging portion enabling any "bunching" or "crinkling" of said waist-engaging portion to be distributed uniformly around said waist of said user and thereby make it possible to keep the amount of "bunching" or "crinkling" at any given point along said waist-engaging portion to a minimum, the automatic further extension of the length of said resilient extensible section and the subsequent automatic reduction of the length of said resilient, extensible section, in reponse to changes in the waist size of said user as said user breathes inwardly or breathes outwardly or as said user moves his body, enabling the tied flexible ends of said drawstring to resist accidental loosening thereof and also enabling said waist-engaging portion to maintain said frictional engagement which will keep said waist-engaging portion from slipping downwardly relative to said waist of said user.

2. A garment as claimed in claim 1 wherein said means comprises a tunnel adjacent said waist-engaging portion which encloses and conceals the major portion of said drawstring and encloses and conceals all of said extensible resilient section.

3. A garment as claimed in claim 1 wherein at least one part of said extensible resilient section is secured to said garment in the rear of said garment.

4. A garment as claimed in claim 1 wherein said means comprises a tunnel adjacent said waist-engaging portion which encloses and conceals the major portion of said drawstring and encloses and conceals all of said extensible resilient section, and wherein said readily-flexible ends project from said tunnel in the front of said garment.

5. A garment as claimed in claim 1 wherein the freedom of said major portion of the length of said extensible resilient section to move relative to said waist-engaging portion enables the amount of initial extension of said extensible resilient section to be limited only by the comfort level of said user.

6. A garment as claimed in claim 1 wherein said extensible resilient section is connected to the rest of said drawstring without having any stitches therein.

7. A garment as claimed in claim 1 wherein the unstressed length of said drawstring is greater than said length of said waist-engaging portion.

8. A garment as claimed in claim 1 wherein said resilient, extensible section has only one area thereof fixedly secured to said garment, and wherein said one area is close to the midpoint of said resilient, extensible section.

9. A garment as claimed in claim 1 wherein said resilient extensible section is an endless loop, and wherein adjacent parts of said drawstring are secured to said resilient extensible section by passing the ends thereof through said endless loop and then bending said ends back toward, and securing said ends to, confronting areas of said adjacent parts.

* * * * *